United States Patent [19]

Mugrauer

[11] 4,311,723

[45] Jan. 19, 1982

[54] METHOD OF VAPOR FIXING A TONER

[75] Inventor: Hubert Mugrauer, Poering, Fed. Rep. of Germany

[73] Assignee: Siemens Aktiengesellschaft, Berlin & Munich, Fed. Rep. of Germany

[21] Appl. No.: 213,941

[22] Filed: Dec. 8, 1980

Related U.S. Application Data

[63] Continuation of Ser. No. 63,905, Aug. 6, 1979.

[30] Foreign Application Priority Data

Aug. 11, 1978 [DE] Fed. Rep. of Germany ..... 2835284

[51] Int. Cl.[3] ..... B05D 1/04

[52] U.S. Cl. ..... 427/14.1; 427/335

[58] Field of Search ..... 427/14.1, 335

[56] References Cited

U.S. PATENT DOCUMENTS

| | | | |
|---|---|---|---|
| 2,726,166 | 12/1955 | Greaves | 117/21 |
| 3,049,810 | 8/1962 | Iwerks | 34/151 |
| 3,324,791 | 6/1967 | Cassano et al. | 100/172 |
| 3,383,775 | 1/1968 | Yuash et al. | 34/23 |

*Primary Examiner*—Bernard D. Pianalto

*Attorney, Agent, or Firm*—Hill, Van Santen, Steadman, Chiara & Simpson

[57] ABSTRACT

A fixing device in a printing or copying means which fixes a toner applied to a data-carrier, i.e., a paper web, via a solvent comprising an azeotropic mixture, such as one consisting of 50.5 weight % of $C_2Cl_3F_3$ and 49.5 weight % of $CH_2Cl_2$.

2 Claims, 1 Drawing Figure

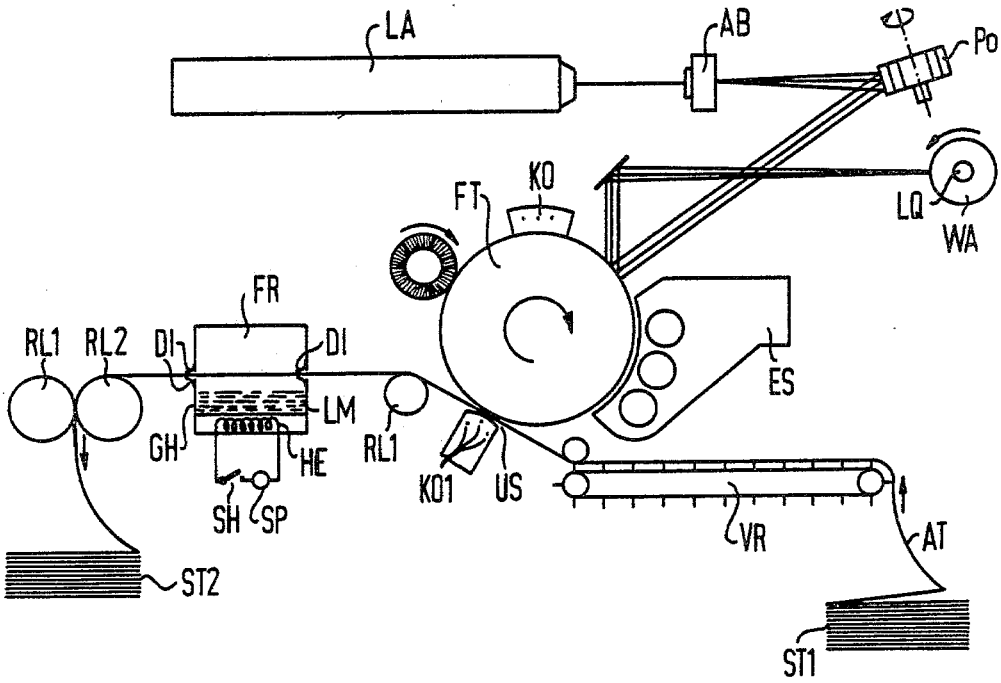
LA
AB
Po
KO
FT
LQ
WA
FR
RL1
RL2
DI
DI
LM
GH
HE
RL1
ES
KO1
US
SH
SP
VR
AT
ST2
ST1

METHOD OF VAPOR FIXING A TONER

This is a continuation of application Ser. No. 63,905, filed Aug. 6, 1979.

BACKGROUND OF THE INVENTION

1. Field of the Invention

The invention relates to the field of xerography and somewhat more particularly to an improved fixing device in a printing or copying means for fixing toner images on support surfaces and to a solvent utilized in such devices.

2. Prior Art

Non-mechanical printing and copying means which operate in accordance with electrostatic principles are known in the art (for example see U.S. Pat. No. 3,861,863). In such printing or copying devices, toner images of the indica or characters which are to be printed are produced on a data carrier, for example, a web of paper. Such toner image production can be effected, for example, by printing charge images of the characters to be produced electrographically or electrophotographically on a photoelectric or dielectric subcarrier, for example a drum. These charge images are developed in a developer station using a toner. The toner images are then transferred to a data carrier in a reproduction station. Thereafter, the toner images are fused into or onto the data carrier in a fixing device, so that they attain a smear-free state.

Fixing devices which fuse the toner image into a data carrier are also known in the art (for example, see U.S. Pat. No. 3,861,963 or U.S. Pat. No. 3,324,791). In these fixing devices, the data carrier, after leaving the reproduction station, passes between two fixing rolls at least one of which is heated. The toner particles are fused into the data carrier by heat and pressure.

It is also known to fuse or fix a toner into a data carrier via solvent vapors (for example, see U.S. Pat. No. 3,049,810). In order to accomplish such toner fixing, a solvent vapor is produced which is capable of melting or plasticizing the toner on the data carrier, so that the toner can penetrate into the data carrier. The solvent vapor is directed to the data carrier provided with the toner images via a suitable device. Generally, such fixing device consists of a housing which contains a vaporization station and a data carrier guide which guides the data carrier through the housing. The fixing device is designed in such a manner that the least possible amount of solvent vapor can escape into the surrounding environment.

The solvents utilized for fixing purposes to produce a solvent vapor must exhibit a low degree of toxicity, should be non-inflammable because of the electrostatic charge associated with such devices, and should not form explosive gas mixtures. Heretofore, pure hydrocarbons and chlorinated and fluoridated hydrocarbons have been used as solvents. However, such solvents either exhibit inflammability with a relatively low degree of toxicity, or non-inflammability with a relatively high degree of toxicity.

SUMMARY OF THE INVENTION

The invention provides a solvent for toner fixing devices which exhibits a low degree of toxicity and is non-inflammable.

In accordance with the principles of the invention, a fixing device for a printing means which fuses a toner applied to a data carrier is provided with a solvent comprised of an azeotropic mixture. A preferred azeotropic mixture is comprised of about 50.5 weight % trichlortrifluorethane and 49.5 weight % of dichlormethane. Another preferred azeotropic mixture consists of about 87.5 weight % trichlortrifluorethane and 12.5 weight % acetone.

BRIEF DESCRIPTION OF THE FIGURE

The FIGURE is a somewhat schematic view of an electrophotographic printing device useful in the practice of the invention.

DESCRIPTION OF PREFERRED EMBODIMENTS

The invention provides a solvent for toner fixing devices in a printing or copying means.

In printing or copying means, toner images of the characters which are to be printed are produced on a data carrier such as a paper web. The toner images consists of developed charge images which, for example, have been formed on a photoelectric surface by means of a character generator. In order to convert the toner images on the data carrier into a smear-free condition, such images must be fused into the data carrier. Such fusion occurs in a fixing device wherein the toner images are exposed to a solvent vapor, the composition of which is such as to dissolve and fix a toner. In accordance with the principles of the invention, the solvent utilized in such fixing devices comprises an azeotropic mixture.

Azeotropic mixtures are generally known in the art. They are mixtures of liquids which boil at a constant rate in given mixture ratio. The composition of azeotropic mixtures does not undergo changes during boiling or distillation.

A preferred azeotropic mixture consists of about 50.5 weight % of trichlortrifluorethane ($C_2$, $Cl_3$, $F_3$) and 49.5 weight % dichlormethane ($CH_2$, $Cl_2$).

A further preferred azeotropic mixture consists of about 87.5 weight % trichlortrifluorethane ($C_2$, $Cl_3$, $F_3$) and 12.5 weight % acetone ($C_3$, $H_6O$).

The azeotropic mixtures of the invention are advantageous useful in toner fixing devices because they are non-flammable, do not form explosive mixtures, exhibit only a relatively low degree of toxicity and dissolve and fix dry toners comprised of a polystyrol base.

DETAILED DESCRIPTION OF THE FIGURE

Referring now to the FIGURE, an exemplary embodiment of an electrostatic printing means is illustrated. The core of this printing means comprises a photoconductive drum FT. The surface of the photoconductive drum FT is provided with a photoelectric coating. This coating is first uniformly charged with the aid of a Korotron KO. The charge images of the characters to be printed are produced on the photoconductor drum by partially illuminating the surface (containing the photoelectric coating) of this drum. Such illumination can be effected with the aid of a character generator comprising of a laser LA, a deflector cell AB and a polygon reflector PO. In the deflector cell AB, for example an acousto-optical deflector cell, the light coming from the laser LA is split into sub-beams corresponding to the characters to be printed and such sub-beams are then deflected onto the surface of the photoconductor drum FT by the polygon reflector PO. The surface of the drum is partially discharged in accordance with the sub-beams reflected onto the photoconductor drum. It is also possible to produce charge images in forms which must be printed on the photoconductor drum FT using a form printer. In such an arrangement, a transparent roller WA is provided and contains therein a light source LQ. A negative of the form to be copied is applied to the roller WA. This negative is illuminated from the interior and the light beams emanating from the form are then reflected onto the surface of the photoconductor drum FT.

The charge images produced on the surface of the photoconductor drum FT by the character generator or the form printer are developed in the developing station ES, i.e., are provided with a toner. The developer station can be conventional, i.e., may contain magnetic brushes or the like.

The developed charge images on the photoconductor drum FT then pass to a reproduction station US which contains a second Korotron KO1. The electrostatic field existing in the reproduction station US causes the toner images to be transferred onto a data carrier AT, for example paper web. The toner images adhere to the surface of the data carrier AT in a smearable fashion.

The data carrier AT is taken from a supply stack ST1 and fed to the reproduction station US via feed caterpillars VR. A roller RL1 is positioned after the reproduction station US and diverts and guides the data carrier to a fixing device FR. The fixing device FR comprises a housing GH through which the data carrier AT is conveyed. Within the housing GH, a solvent vaport required for fixing purposes is produced from a solvent bath LM. As shown, the solvent bath LM is positioned along the base of the housing FR. A heating device HE is positioned beneath the solvent bath LM for controllably heating and thus vaporizing the solvent in the solvent bath LM. The solvent vapors so-developed contact the data carrier, particularly the toner applied onto the data carrier and dissolve or plasticize the toner so as to enable it to penetrate into the data carrier.

The heating device HE is operationally connected to a voltage source SP which can be switched on and off by means of a switch SH. It will be understood that the fixing device FR is only shown schematically and further details thereof can be gathered, for example, from the earlier mentioned U.S. patents.

In order to prevent undue solvent vapor escape from the housing GH, the points of entry and exit of the data carrier AT into such housing are provided with gas seals DI.

From the fixing device FR, the data carrier AT passes to further rollers RL2 and RL3 via which the data carrier is transmitted to a storage stack ST2.

In accordance with the principles of the invention, the solvent bath LM is comprised of an azeotropic mixture and which produces solvent vapors useful in fixing toners. A preferred azeotropic mixture is one consisting of about 50.5 weight % trichlorotrifluoroethane ($C_2Cl_3F_3$) and about 49.5 weight % trichloromethane ($CH_2Cl_2$). Another preferred azeotropic mixture is comprised of about 87.5 weight % $C_2Cl_3F_3$ and about 12.5 weight % $C_3H_6O$.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. A method of vapor-fixing a toner on a data-carrier comprising contacting such toner with a solvent thereof composed of an azeotropic mixture consisting of about 50.5 wt. % of trichlortrifluorethane and about 49.5 wt. % of trichloromethane.

2. A method of vapor-fixing a toner on a data-carrier comprising contacting such toner with a solvent thereof composed of an azeotropic mixture consisting of about 87.5 wt. % of trichlortrifluorethane and about 12.5 wt. % of acetone.

* * * * *